United States Patent [19]

Jönsson

[11] 4,351,256

[45] Sep. 28, 1982

[54] METHOD FOR MANUFACTURE OF A BOAT DECK HAVING A SURFACE OF ADJACENT STRIPS, AND A DECK MANUFACTURED ACCORDING TO THE METHOD

[76] Inventor: Sven A. Jönsson, Nykarlebygatan 49, Spånga, Sweden, S-163 26

[21] Appl. No.: 120,350

[22] Filed: Feb. 11, 1980

[30] Foreign Application Priority Data

Feb. 19, 1979 [SE] Sweden ..... 7901461

[51] Int. Cl.[3] ..... B63B 3/00; B63B 5/00

[52] U.S. Cl. ..... 114/85

[58] Field of Search ..... 9/6 R, 6 W, 6.5, 1.7; 114/85, 65 R; 144/309 AB, 316; 428/511; 52/828; 156/271, 254, 60

[56] References Cited

U.S. PATENT DOCUMENTS

| | | | |
|---|---|---|---|
| 1,484,200 | 2/1924 | Vincke | 156/254 |
| 2,245,497 | 6/1941 | Potchen | 52/828 |
| 3,277,939 | 10/1966 | Scott | 144/316 |

*Primary Examiner*—Frank Sever

*Attorney, Agent, or Firm*—Holman & Stern

[57] ABSTRACT

A method for the manufacture of a deck of adjacently located strips for series-produced decked boats, including the steps of arranging a number of strip members in a parallel relationship, separated from each other by means of intermediately located spacing members, thus giving the strip members a longitudinally extending curved configuration mainly corresponding to the deck line of the boat to which the deck is intended to be attached, thereafter applying a supporting and joining member against the free edge portions of the strip members, and by means of an adhesive, vulcanization, or similar previously known method producing a joint between the strip members and the supporting and joining member, whereafter the spacing members located between the strip shaped members are removed. As a further step, the strip members are arranged with a height corresponding to at least twice the intended height, and a second joining and supporting member is attached against the strip members in an opposed relationship to the first member, whereafter the strip members are divided along a central longitudinally extending line, thereby forming two mirror image deck halves.

10 Claims, 5 Drawing Figures

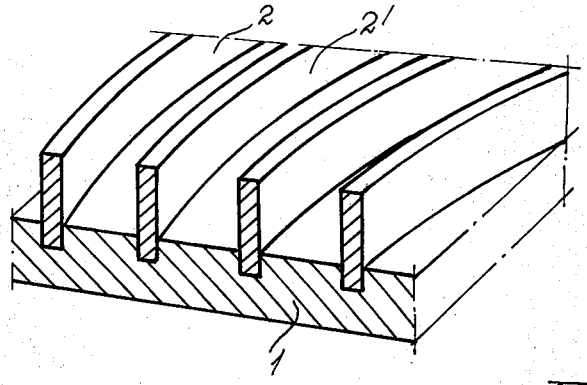
Fig. 1
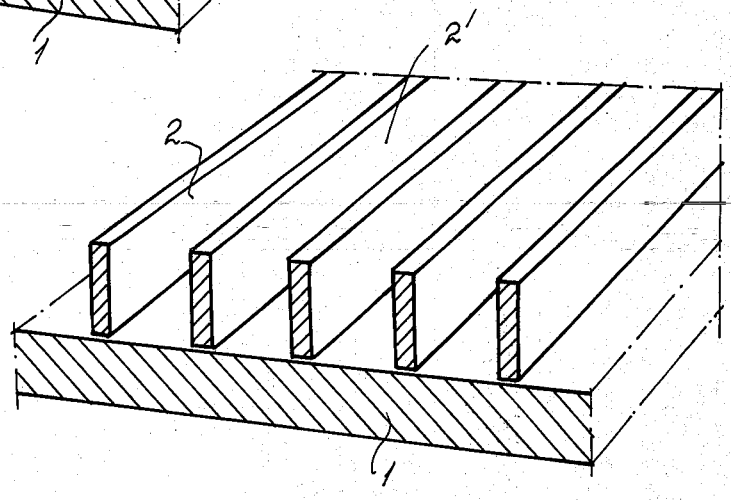
Fig. 2
Fig. 3
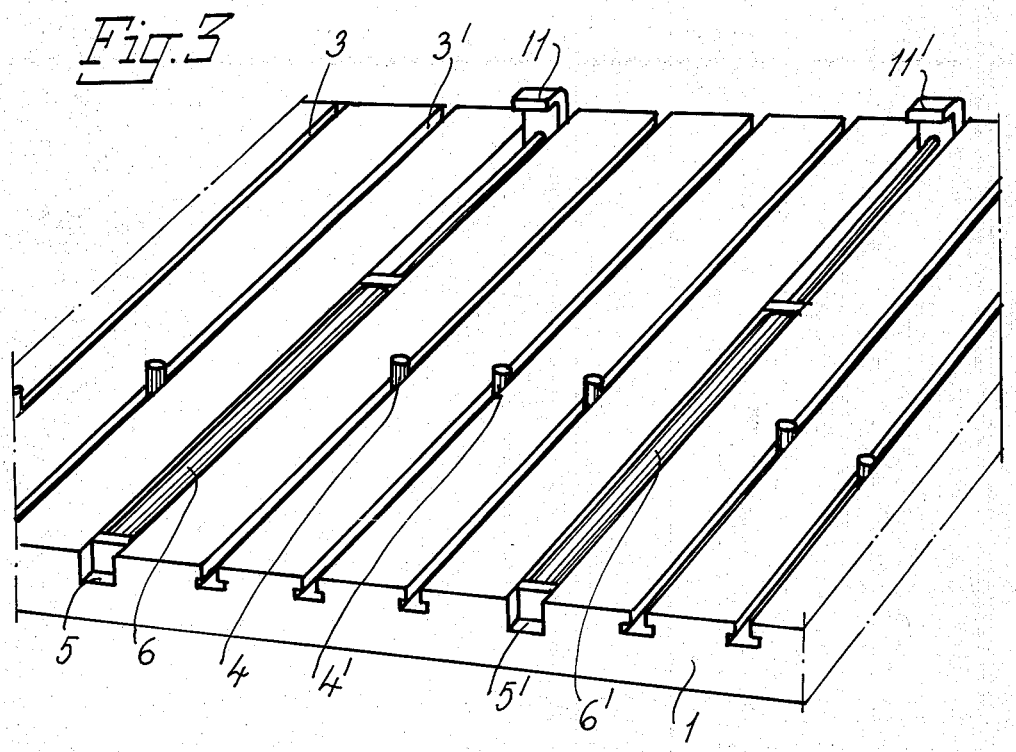

METHOD FOR MANUFACTURE OF A BOAT DECK HAVING A SURFACE OF ADJACENT STRIPS, AND A DECK MANUFACTURED ACCORDING TO THE METHOD

BRIEF SUMMARY OF THE INVENTION

The present invention relates to a method for manufacture of a boat deck having a surface of adjacent strips, e.g. teak strips, intended to be attached to series-produced decked boats, and a deck manufactured according to the method.

It is previously known to attach a cover of teak strips against the deck of a series-produced boat, each individual strip being independently shaped and attached against the deck of the boat. Obviously, this method is extremely time consuming and expensive, and the person performing this work must also possess considerable professional skill. An alternative solution would be to use two boards having a shape corresponding to each fore-and-aft side portions, against one side of which strips are bent corresponding to the deck line, attached by means of screws and a rubber compound. This solution would make it possible to manufacture deck halves on an industrial scale in suitable premises, which halves, without any professional skill can be attached against, for example, a glass fibre deck of a series-produced boat. The attachment of said boards can be performed by means of screws.

To manufacture a board shaped deck on an industrial scale considerably reduces the cost in relation to previously used methods, based on individual attachment of strips directly against the deck of the boat. However, the improved method has certain disadvantages, since each individual strip must be shaped and attached separately against the board shaped and supporting member and this makes it necessary to have considerable professional skill. Each fore-and-aft half is also manufactured individually, and a simpler and faster method is obviously desired.

The object of the present invention is to disclose a method for manufacture of deck halves, including a supporting member, against which a number of strips are attached, which strips are arranged to form a teak deck. The manufacturing method according to the present invention makes it also possible to manufacture two fore-and-aft halves in one operation only, i.e. a port and a starboard half, whereby a complete deck is manufactured in one operation only, with regard to attachment of the strips against supporting members. The present invention also includes a deck manufactured according to the method.

The characteristic features for the method of the present invention are disclosed in the following main claim, as well as related subclaims, which subclaims also disclose the characteristic features of a deck manufactured according to the method.

The method according to the present invention, and a deck manufactured according to the method, are more fully described below with reference to the accompanying drawings.

BRIEF DESCRIPTION OF THE DRAWINGS

FIG. 1 is a fragmentary view of a first embodiment of a fixture, intended to be used in connection with the method.

FIG. 2 is a fragmentary view corresponding to FIG. 1 of a second embodiment of a fixture, intended to be used in connection with the method.

FIG. 3 is a perspective view of a portion of a third embodiment of a fixture, intended to be used in connection with the method.

DETAILED DESCRIPTION

Figure 4:
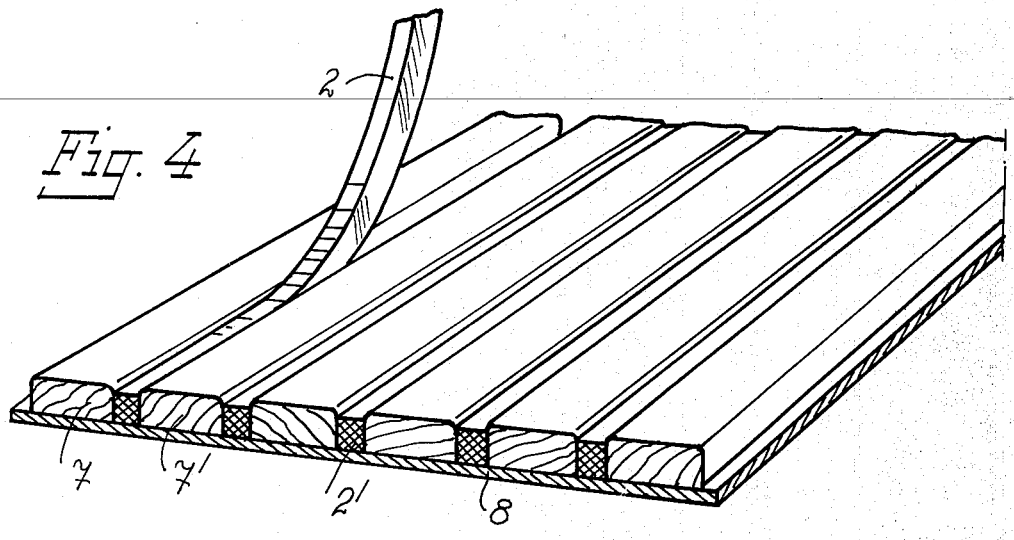
FIG. 4 is a fragmentary view of a deck when removing a spacing member located between the strips.

The method according to the present invention is based on the use of a manufacturing fixture, which fixture has a configuration, or is adjustable, in relation to the deck shape for which a deck of adjacently located strips is to be manufactured.

With reference to FIG. 1, a first embodiment of such a manufacturing fixture is shown, including a base plate 1 against which a number of longitudinally extending spacing members 2, 2' are attached. Said spacing members 2, 2' have a height, extending from the surface of the base plate 1, which is slightly less than the height of the strips intended to be attached to a supporting member, and the space between two adjacent planes of the members 2, 2' is arranged basically corresponding to the width of the strips. Furthermore, the members 2, 2' are attached to the base plate 1 in such a way, that the strips, when inserted between the members 2, 2', take up a curved configuration corresponding to the deck line for the deck to be manufactured. When the strips have been placed between the members 2, 2', a suitable adhesive is applied against the supporting member and/or the strips, whereafter a joining and supporting member is placed against the strips. The supporting member is thereafter made subject to application of a pressure, in order to achieve complete contact against the strips during the hardening operation for the adhesive. The supporting member is thereafter removed from the fixture together with the strips, attached against the board shaped supporting member.

The embodiment shown in FIG. 1 can be further modified, in order to simplify removal of the deck, when the strips have been joined to the supporting member. The base plate 1, or part thereof, can be arranged vertically movable in relation to the spacing members 2, 2', whereby the base plate 1, or part thereof, can be moved in a direction towards the free end surfaces of the spacing members to a position, in which the plane of the base plate 1 mainly corresponds with the free end surfaces of the members 2, 2'. Alternatively, the members 2, 2' can be arranged movable in relation to the base plate 1, in which case the members 2, 2' are arranged movable in a direction towards the base plate 1 to a position, in which the free end surfaces of the members 2, 2' mainly correspond with the plane of the base plate 1. Said movement can be achieved mechanically, hydraulically, pneumatically or in any other previously known way.

When the spacing members 2, 2' are non-flexible members, difficulties can occur when removing the completed deck half from the fixture. This can be avoided by manufacturing the members 2, 2' from a flexible and compressible material, such as rubber, synthetic plastics or similar materials, which in the shape of strips are inserted between the deck strips, or are arranged attached to a co-acting frame.

An example of a fixture for such an embodiment is shown in FIG. 2. In order to bend the strips to the desired curved shape, fixed abutment means can be arranged adjacent to the outer strips of the deck halves.

An alternative embodiment of such a fixture is shown in FIG. 3, including a table shaped base plate 1, arranged with a number of cross-wisely extending grooves 3, 3', in which abutment means 4, 4' are moveable and lockably arranged. Between said grooves 3, 3' (in the shown embodiment as every fourth groove), a further groove 5, 5' is provided, surrounding a hydraulical cylinder 6, 6', piston rod end being arranged with a pressure-acting member 11, 11'. When using the fixture, the moveable abutment means 4, 4' are first located in accordance with a template having the desired deck line, thereafter being locked in said locations. Strips are thereafter placed on the base plate 1, whereafter the cylinders 6, 6' are activated, whereby the strips are bent in a configuration corresponding to the desired and preset shape. When the strips are placed against the base plate 1, a flexible and longitudinally extending spacing member 2, 2' is located between each strip, whereby the strips, when shaped with said members 2, 2', are arranged in a separated position with respect to each other.

An example of such a spacing member 2, 2' is shown in FIG. 4, said member 2, 2' being a flexible strip, in said figure shown when being removed from an intermediate position between two strips 7, 7', attached to a board-shaped and supporting member 8.

As previously mentioned, the strips 7, 7' and the joining and supporting member 8 are preferably joined to each other during application of pressure. The pressure can be applied directly against the member 8 placed on the strips 7, 7' by means of a pressure-acting part, or by means of vacuum.

Figure 5:
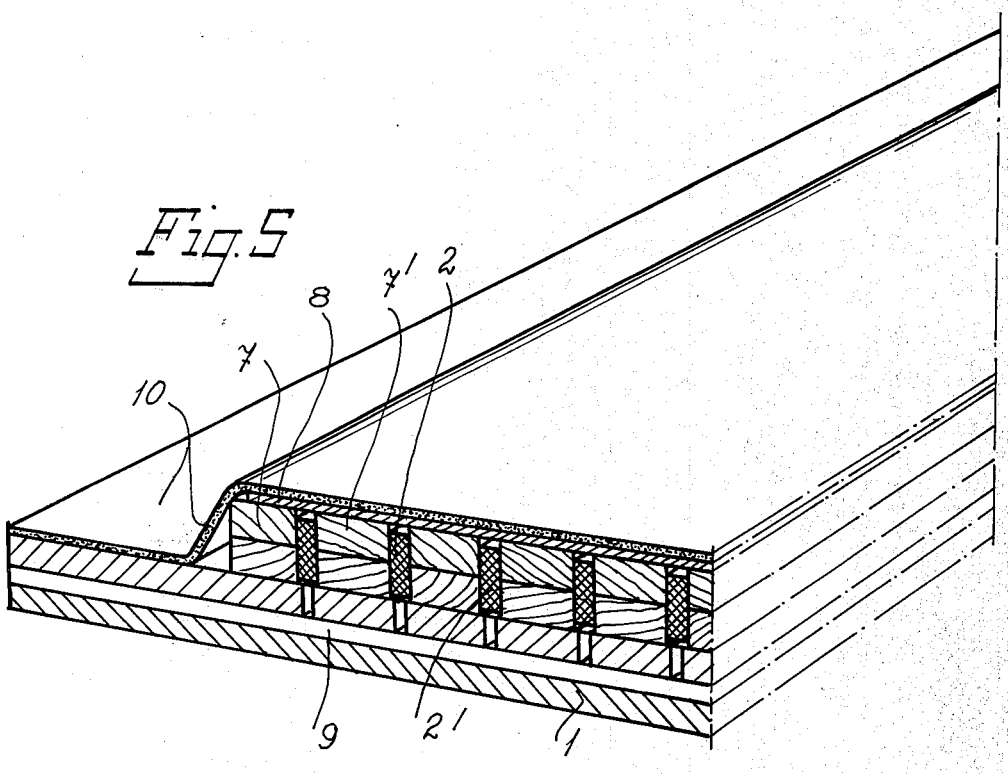
FIG. 5 is a cross-sectional view of a part of a deck arranged in a manufacturing fixture.

An example of this is shown in FIG. 5, the table-shaped base plate 1 being arranged communicating with a vacuum channel 9, and with a flexible cloth 10, e.g. of rubber, synthetic plastics or similar material, applied surrounding the supporting member 8 located on the free surfaces of the strips 7, 7'. Hereby the supporting member 8 is forced by means of the vacuum against the strips 7, 7'.

The method according to the present invention makes it possible to manufacture one fore-and-aft deck half in each operation, or two deck halves, a port and a starboard half, whereby a complete deck is manufactured in each insertion operation. The aforementioned operation can be achieved basically in two ways, either by use of strips 7, 7' having a height corresponding to or exceeding twice the height of the finished deck, or by using double and adjacent strips 7, 7' located between the spacing members 2, 2'. In the first mentioned case, a first joining and supporting member 8 is attached in the previously described manner, whereafter the joined unit is turned over after intermediately located members 2, 2' have been removed, whereafter a second joining and supporting member is attached against the free end surfaces of the strips 7, 7'. The joined unit is thereafter separated and divided, e.g. by means of a sawing operation, whereby two mirror image deck halves result i.e. a port and a starboard part.

When using two adjacent strips 7, 7', said strips can be arranged as two in relation to each other not joined and separate parts, in which case the manufacturing fixture is arranged in such a way, that the unit formed after application of a first joining and supporting member 8 can be rotated, while maintaining the fixed position of the strips, thereafter a second joining and supporting member is attached in an opposed relationship to the first member.

However, this method makes it necessary to use fixing means to hold the unjoined strips 7, 7' during the rotating operation. This can be avoided by joining strips 7, 7' in contact with each other by means of an adhesive arranged to facilitate separation of the joint, when heat or a solvent is applied. In this case, the strips 7, 7' are glued to a position in contact with each other, whereafter a first joining and supporting member is applied and attached in the above described manner. The joined unit can thereafter be removed from the fixture and turned, whereafter a second joining and supporting member is applied in an opposed relationship to the first member. Separation of the joined strips 7, 7' is thereafter accomplished by application of heat, a solvent or any other joint dissolving means, whereby the joined strips 7, 7' are separated, thus forming two mirror image deck halves, which consist of a port and a starboard part.

It should be emphasized that the described method also can be utilized with other types of separating members 2, 2' for the strips 7, 7' than longitudinally extending strips or band shaped members. However, band shaped members 2, 2' of rubber or synthetic plastics are often preferred, since these easily can be removed when the first supporting member 8 has been attached.

The joining and supporting member 8 is preferably a board-shaped member, e.g. plywood, but other materials can also be used, e.g. glass fibre reinforced synthetic plastics. In the last mentioned case, the supporting member can comprise a woven or wire shaped glass fibre intended to serve as a reinforcement in connection with an added synthetic plastic material, and the added synthetic plastics material can also be used to achieve desired adhesive properties for fixation of strips 7, 7'. The supporting member 8 can also be other than woven or mat shaped materials, such as reinforced rubber, synthetic rubber or synthetic plastics, in order to achieve a more flexible supporting member 8, joined to the strips by means of application of an adhesive, vulcanisation or any other previously known joining method.

It should also be emphasized, that the strips 7, 7' obviously normally comprise of teak strips or strips 7, 7' of similar types of wood, but that also strips from other materials can be used. For example, strips 7, 7' of synthetic rubber, synthetic plastics or similar materials can be used, which materials also can include additives intended to reduce slipping properties. Such strips make it possible to achieve numerous different colours, as well as good wearing properties, slip reducing properties, as well as a reduction of manufacturing costs (the material cost) for the deck. If strips 7, 7' of rubber, synthetic rubber, synthetic plastics or other materials having flexible and compressible properties are used, the manufacturing fixture can also be modified, since the strips 7, 7' can easily be brought to take up desired longitudinal curved configuration, and since they can easily be removed from a base plate 1 in the fixture, even if non-flexible members 2, 2' are used. The present invention thus includes numerous possibilities to design a suitable manufacturing fixture, in view of the fact that the method can be used for different types of material, both with regard to the strips 7, 7' and the joining and supporting member 8. The method according to the present invention can thus be used in a number of different applications, modified on the basis of the different modifications previously disclosed, and a deck manufactured according to the method can also be varied in a number of ways.

I claim:

1. A method for the manufacture of a boat deck having a surface of spaced deck strips, comprising providing a fixture having a base plate and spacing members thereon in spaced relationship for separating adjacent deck strips from each other, inserting said strips into the spaces between said spacing members and against said base plate, forming said strips into a longitudinally extending curved configuration corresponding to the desired longitudinally extending curved configuration of a fore-and-aft half of the deck surface to which the deck is intended to be attached, applying a bonding means to the free longitudinally extending surfaces of said strips opposite said base plate, and bonding a joining and supporting member to said free longitudinally extending surfaces of said strips.

2. A method according to claim 1, wherein said spacing members are arranged in a configuration corresponding to said longitudinally extending curved configuration and said strips are formed into said curved configuration when inserted into the fixture.

3. A method according to claim 2, and further comprising removing the deck, comprised of said strips joined to the joining and supporting member, from the fixture by moving said spacing members relatively to said base plate to a position in which the free end portion of the spacing members and the base plate are located in substantially the same plane.

4. A method according to claim 1, wherein said strips are inserted between substantially parallel band shaped spacing members, whereafter the strips with said spacing members are subjected to a force directed substantially perpendicular to the longitudinal direction of the strips, said force being applied to bend the strips with the intermediately located spacing members into a longitudinally extending curved configuration substantially corresponding to the longitudinally extending curved configuration of a fore-and-aft half of the deck surface to which the deck is intended to be attached.

5. A method according to claim 4, wherein said spacing members comprise flexible band members, such as rubber, synthetic rubber, or synthetic plastics and said bands are removed from the deck by stretching and lifting them relatively to the plane of said strips.

6. A method according to claim 4, wherein said fixture is provided with adjustable abutment means, and further comprising arranging said abutment means in an opposed relationship to the direction of said force application and said longitudinally extending curved configuration, said abutment means acting as restricting members for the curved movement achieved when applying said force.

7. A method according to claim 4, wherein the strips have a height corresponding to at least twice the intended strip height for the completed deck, and further comprising after a first joining and supporting member has been attached and removed from said fixture, applying a bonding means to the free longitudinally extending surfaces of said strips opposite to the first supporting member, bonding a second joining and supporting member to said opposite free longitudinally extending surfaces of the strip members, and dividing said strips longitudinally in half forming two mirror image deck halves.

8. A method according to claim 7, wherein said height of the strip members is achieved by separably attaching two strips to each other, inserting said two attached strip members between adjacent spacing members, and said dividing step comprises separating said strips at said separable attachment.

9. An attachable boat deck attachable to the top deck surface of a boat comprising substantially only a plurality of substantially parallel spaced strips of deck material forming the upper deck surface bonded to a supporting and joining member which is attachable against said top deck surface, said strips being bent into the desired longitudinally extending curved configuration to conform to the fore-and-aft half of the top deck surface to which the boat deck is to be attached, and said boat deck being made by the method recited in any one of claims 1 through 8.

10. The attachable boat deck as claimed in claim 9 wherein said strips are teakwood and said supporting and joining member is plywood.

* * * * *